US008947189B2

(12) United States Patent
Maruyama et al.

(10) Patent No.: US 8,947,189 B2
(45) Date of Patent: Feb. 3, 2015

(54) MULTILAYER CHIP INDUCTOR AND PRODUCTION METHOD FOR SAME

(75) Inventors: Yoshikazu Maruyama, Gunma (JP); Masataka Kohara, Gunma (JP); Kazuhiko Oyama, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

(21) Appl. No.: 13/991,690

(22) PCT Filed: Oct. 19, 2011

(86) PCT No.: PCT/JP2011/073987

§ 371 (c)(1),
(2), (4) Date: Jul. 30, 2013

(87) PCT Pub. No.: WO2012/077413

PCT Pub. Date: Jun. 14, 2012

(65) Prior Publication Data

US 2014/0132385 A1 May 15, 2014

(30) Foreign Application Priority Data

Dec. 8, 2010 (JP) ..... 2010-274072

(51) Int. Cl.

| | |
|---|---|
| ***H01F 27/29*** | (2006.01) |
| ***H01F 5/00*** | (2006.01) |
| ***H01F 27/24*** | (2006.01) |
| ***H01F 7/06*** | (2006.01) |
| ***H01F 27/28*** | (2006.01) |
| ***H01F 17/00*** | (2006.01) |
| ***H01F 41/04*** | (2006.01) |

(52) U.S. Cl.

CPC ..... *H01F 27/2804* (2013.01); *H01F 17/0013* (2013.01); *H01F 41/041* (2013.01); *H01F 41/043* (2013.01); *H01F 2017/0073* (2013.01)

USPC ..... 336/192; 336/200; 336/234; 29/602.1

(58) Field of Classification Search

USPC ..... 336/200, 83, 192, 234; 29/602.1, 605

See application file for complete search history.

(56) References Cited

U.S. PATENT DOCUMENTS

| | | | | |
|---|---|---|---|---|
| 6,504,466 | B1 * | 1/2003 | Katsurada | 336/200 |
| 2009/0115563 | A1 * | 5/2009 | Arata et al. | 336/200 |

(Continued)

FOREIGN PATENT DOCUMENTS

| | | | |
|---|---|---|---|
| JP | 1992-134807 | U | 12/1992 |
| JP | H07-201568 | A | 8/1995 |
| JP | H09-129448 | A | 5/1997 |

(Continued)

OTHER PUBLICATIONS

International Search Report mailed Jan. 10, 2012, issued for International application No. PCT/JP2011/073987.

*Primary Examiner* — Mangtin Lian

(74) *Attorney, Agent, or Firm* — Law Office of Katsuhiro Arai

(57) ABSTRACT

A group of magnetic sheets are stacked and connected via through-holes, on each of which magnetic sheets a circling pattern having connection parts at its corners and ends is formed to form a spiral coil pattern. Leader patterns each have a leader part formed at a position not overlapping with the circling parts of the coil pattern and connected to an external terminal electrode, as well as two connection parts that continue to the leader part and are formed at positions corresponding to the connection parts of the circling patterns, together with a cutout formed between the two connection parts. Magnetic sheets with the leader patterns are provided at the top and bottom of the laminate forming the coil pattern. The multilayer chip inductor can suppress decrease in core area caused by displacement due to the stacking.

4 Claims, 9 Drawing Sheets

(56) References Cited

U.S. PATENT DOCUMENTS

| | | | | |
|---|---|---|---|---|
| 2009/0153282 | A1* | 6/2009 | Taoka et al. | 336/200 |
| 2009/0278649 | A1* | 11/2009 | Tatsukawa et al. | 336/200 |

FOREIGN PATENT DOCUMENTS

| | | | |
|---|---|---|---|
| JP | 2607588 | Y2 | 11/2001 |
| JP | 2003-272914 | A | 9/2003 |

* cited by examiner

MULTILAYER CHIP INDUCTOR AND PRODUCTION METHOD FOR SAME

This application is the U.S. National Phase under 35 U.S.C. §371 of International Application PCT/JP2011/073987, filed Oct. 19, 2011, which claims priority to Japanese Patent Application No. 2010-274072, filed Dec. 8, 2010. The International Application was published under PCT Article 21(2) in a language other than English.

TECHNICAL FIELD

The present invention relates to a multilayer chip inductor and method of manufacturing the same, and more specifically to suppressing any decrease in core area caused by displacement at the time of stacking

BACKGROUND ART

FIGS. 6 to 8 show a general structure of a conventional multilayer chip inductor. The multilayer chip inductor 100 shown in these figures comprises a magnetic body 104 in which a spiral coil pattern 106 that conductively connects multiple circling patterns 112, 114, 116, 118 via a through-hole 130 is buried. The coil pattern 106 is connected, via leader patterns 120, 124, to external terminal electrodes 108, 110 formed on the end faces of a multilayer chip 102. As shown in FIGS. 8(E) and (F), these leader patterns 120, 124 are continuously formed with circling parts 122, 126 which are formed by conductors identical to the circling patterns 112 through 118. The circling patterns 112 through 118 and leader patterns 120, 124 have land patterns (connection parts) 112A, 112B, 114A, 114B, 116A, 116B, 118A, 118B, 120A, 124A on the respective end faces for connection through the through-hole 130.

As shown in FIG. 7, this multilayer chip inductor 100 is such that, magnetic green sheets (hereinafter referred to as "magnetic sheets") E1 to E4 on which the circling patterns 112 through 118 constituting the coil pattern 106 are provided and the through-hole 130 is formed at specified positions, are stacked in a specified order and then a magnetic sheet E5 on which the leader pattern 120 as well as the through-hole 130 are formed is stacked on top, while a magnetic sheet E6 on which the leader pattern 124 is formed is stacked at the bottom. In addition, a specified number of magnetic sheets G having no conductive pattern formed on them are stacked at the top and bottom of this laminate and sintered, after which the external terminal electrodes 108, 110 to connect to the leader patterns 120, 124 are formed on the end faces of the obtained multilayer chip 102, to form the multilayer chip inductor 100. Relating to a multilayer chip inductor like this one, structured by continuous forming of leader patterns and circling patterns, is the technology described in Patent Literature 1 below.

BACKGROUND ART LITERATURE

Patent Literature

Patent Literature 1: Japanese Patent Laid-open No. 2003-272914

SUMMARY OF THE INVENTION

Problems to be Solved by the Invention

As illustrated in the above example shown in FIGS. 6 to 8, formation of the multilayer chip inductor 100 using conductive patterns that are three-quarters of a circle (circling patterns) involves printing the conductive patterns on magnetic green sheets using a circling screen having multiple circling patterns arranged on it and a leader screen having multiple leader patterns arranged on it, and then stacking the magnetic sheets E1 to E6 on which the conductive patterns have been printed. As a result, the lamination accuracy drops due to an overall length accuracy error and alignment error between the screens that cannot be fully aligned at the time of position alignment, which is undesirable as it causes displacement and distortion of conductive patterns, decrease in core area, and drop in inductance.

This condition is explained specifically by referring to FIG. 9 showing how the core area of the multilayer chip inductor 100 changes. FIG. 9(A) shows a condition where displacement due to stacking does not occur, while FIG. 9(B) shows a condition where the circling patterns and leader patterns are displaced. If the circling patterns 112 through 118 that form the spiral coil pattern 106 are displaced from the leader patterns 120, 124 that are stacked at the top and bottom thereof, as shown in FIG. 9(B), parts of a core area 150 of the coil are cut off by the circling part 122 of the leader pattern 120 and circling part 126 of the leader pattern 124. In other words, the core area 150 decreases by a cutoff area 152 shown in FIG. 9(C), thereby causing the inductance to deteriorate. It should be noted that, while FIG. 9(B) shows a condition where the magnetic sheets E5 and E6 are both displaced from the other magnetic sheets E1 to E4 in the same direction by the same amount, the core area 150 still decreases even when either the magnetic sheet E5 or E6 is displaced. Even when dielectric sheets are used in place of magnetic sheets, undesirable conditions like the one mentioned above will result.

The present invention focuses on the above point and the object of the present invention is to provide a multilayer chip inductor that suppresses decrease in core area to maintain the inductance when a coil is formed by stacking multiple insulator layers on which conductive patterns are formed, while permitting the number of coil windings to be changed with ease, as well as a method of manufacturing such multilayer chip inductor. It should be noted that the term "insulator" used in connection with the present invention includes the magnetic body and dielectric body.

Means for Solving the Problems

The multilayer chip inductor proposed by the present invention comprises:

a multilayer chip which comprises a laminate of roughly rectangular solid shape formed by stacking multiple insulator layers, in which a spiral coil pattern circling in a roughly rectangular shape along each side of the laminate is embedded; and external terminal electrodes provided on the end faces of the multilayer chip;

wherein such multilayer chip inductor is characterized in that the multilayer chip has:

multiple first insulator layers on each of which a circling pattern, which has connection parts at its corners and ends, is formed;

a coil pattern formed by interconnecting via through-holes the ends of the circling patterns on the multiple first insulator layers; and a pair of second insulator layers provided at the top and bottom of the laminate of the multiple first insulator layers and on each of which a leader pattern is formed, where each leader pattern has a leader part formed at a position not overlapping with the circling parts of the coil pattern and connected to the external terminal electrode, two connection parts that continue to the leader part and correspond to the connection parts of the circling pattern on the closest first insulator layer, and a cutout formed between the two connection parts by removing parts overlapping with the circling pattern;

wherein the coil pattern and the leader pattern are connected via a through-hole at one of the two connection parts of each leader pattern. One main embodiment is characterized in that the leader patterns have symmetrical shapes.

The method of manufacturing a multilayer chip inductor proposed by the present invention is the method of manufacturing the multilayer chip inductor according to Embodiment 1 or 2, characterized by comprising:

stacking, on one of the second insulator layers, the first insulator layer on which a through-hole is formed at a position corresponding to one of the two connection parts of the leader pattern on the one of the second insulator layers and which has the circling patterns;

stacking, on top thereof, the multiple first insulator layers in a specified order so as to form a spiral coil pattern;

further stacking, on top thereof, the other of the second insulator layers which has a through-hole at a position corresponding to one of the closest two connection parts of the circling pattern on the first insulator layer at the top;

sintering the obtained laminate; and forming external terminal electrodes on the end faces where the leader patterns are exposed.

The above and other objects, characteristics and advantages of the present invention are made clear by the detailed explanations below and the drawings attached hereto.

Effects of the Invention

According to the present invention, insulator layers on which a circling pattern is formed are stacked to form a spiral coil pattern, with connection parts provided at the corners and ends of the circling pattern. Then, leader patterns are provided at the top and bottom of the coil pattern, where each leader pattern has a leader part formed at a position not overlapping with the circling parts of the coil pattern, two connection parts continuing to the leader part and corresponding to the connection parts of the circling pattern of the closest first insulator layer, and a cutout formed between the two connection parts, and the leader patterns are connected to the external terminal electrodes. Because of this, decrease in core area can be suppressed to maintain the inductance even when the circling patterns are displaced from the leader patterns at the time of stacking In addition, the number of coil windings can be changed with ease because the leader patterns have connection parts at two locations and connection parts are also provided at the corners of the circling patterns.

MODE FOR CARRYING OUT THE INVENTION

A mode for carrying out the present invention is explained in details below based on an example.

EXAMPLE 1

Figure 1:
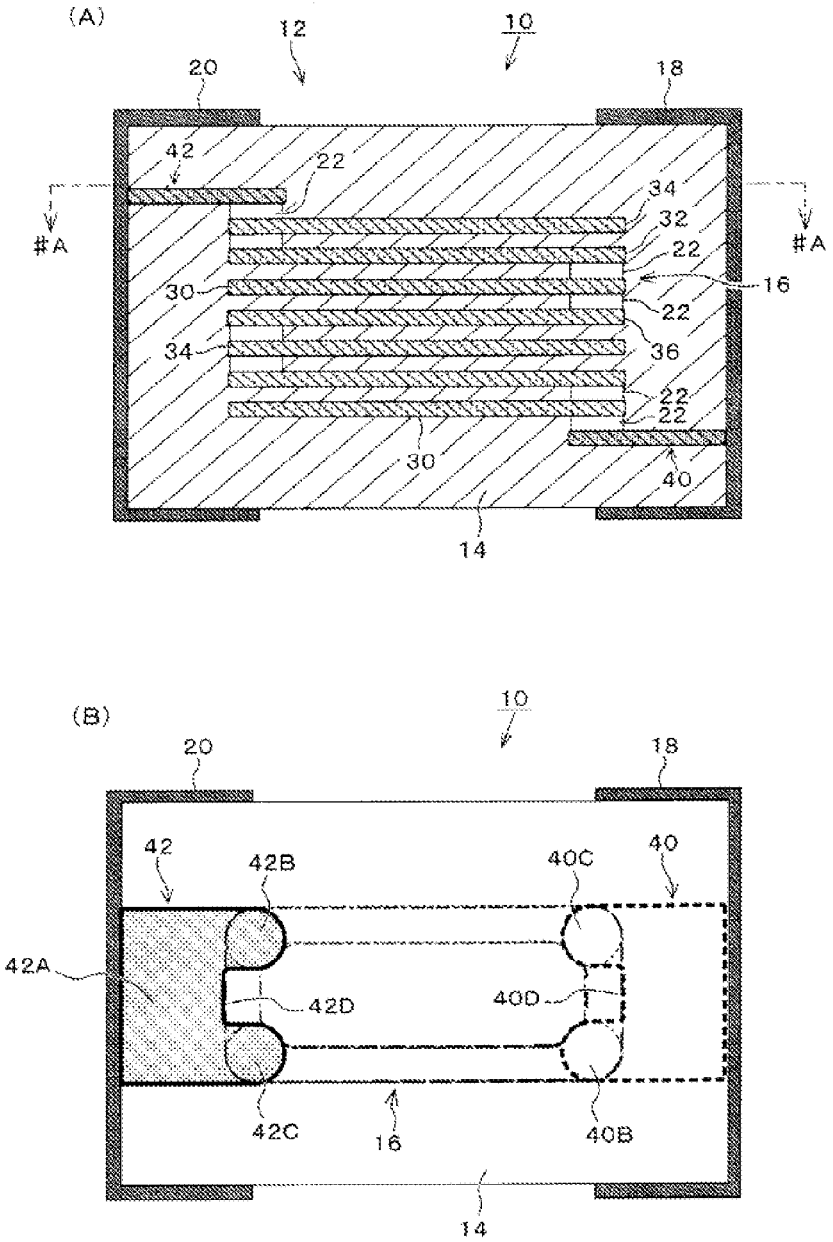
[FIG. 1] is a drawing showing the multilayer chip inductor in Example 1 of the present invention, where (A) is a section view of the chip that has been cut in the lamination direction, while (B) is a section view of (A) above that has been cut along line #A-#A and is viewed in the direction of the arrow.
Figure 2:
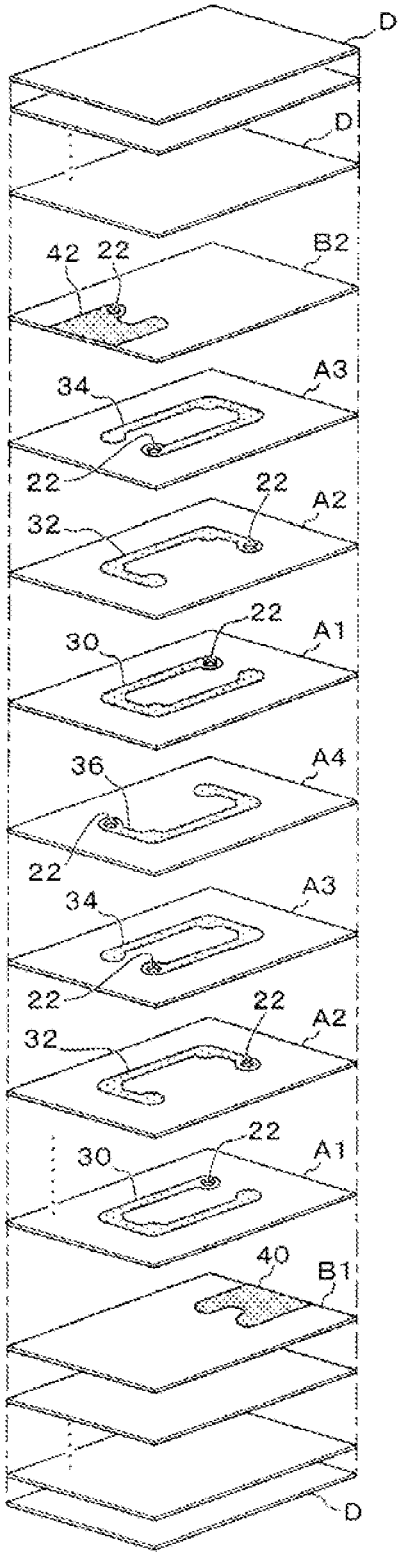
[FIG. 2] is an exploded perspective view showing the sheet lamination structure according to the manufacturing process of the multilayer chip inductor in Example 1 above.
Figure 3:
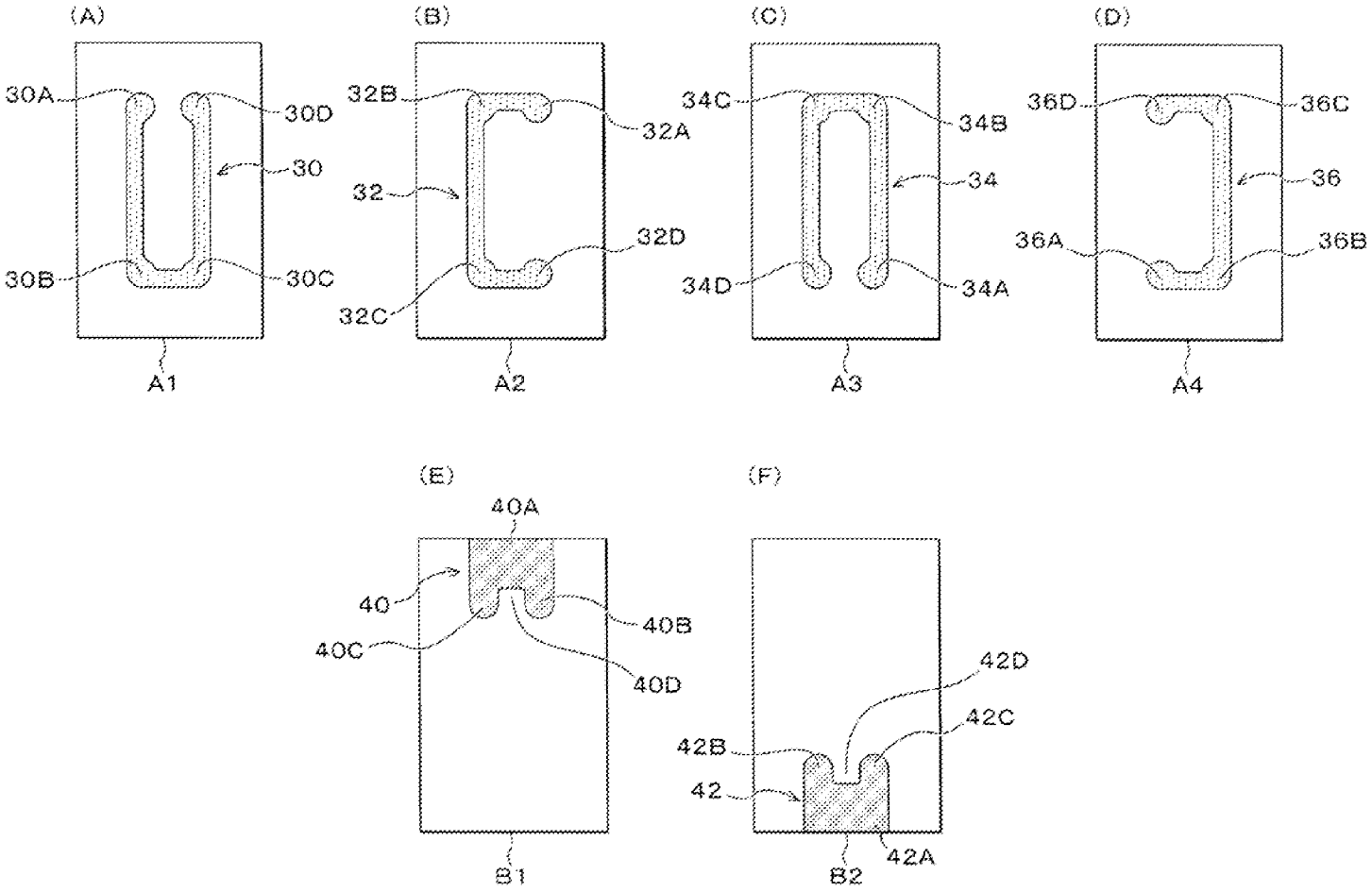
[FIG. 3] is a plan view showing the circling patterns and leader patterns of the multilayer chip inductor in Example 1 above.
Figure 4:
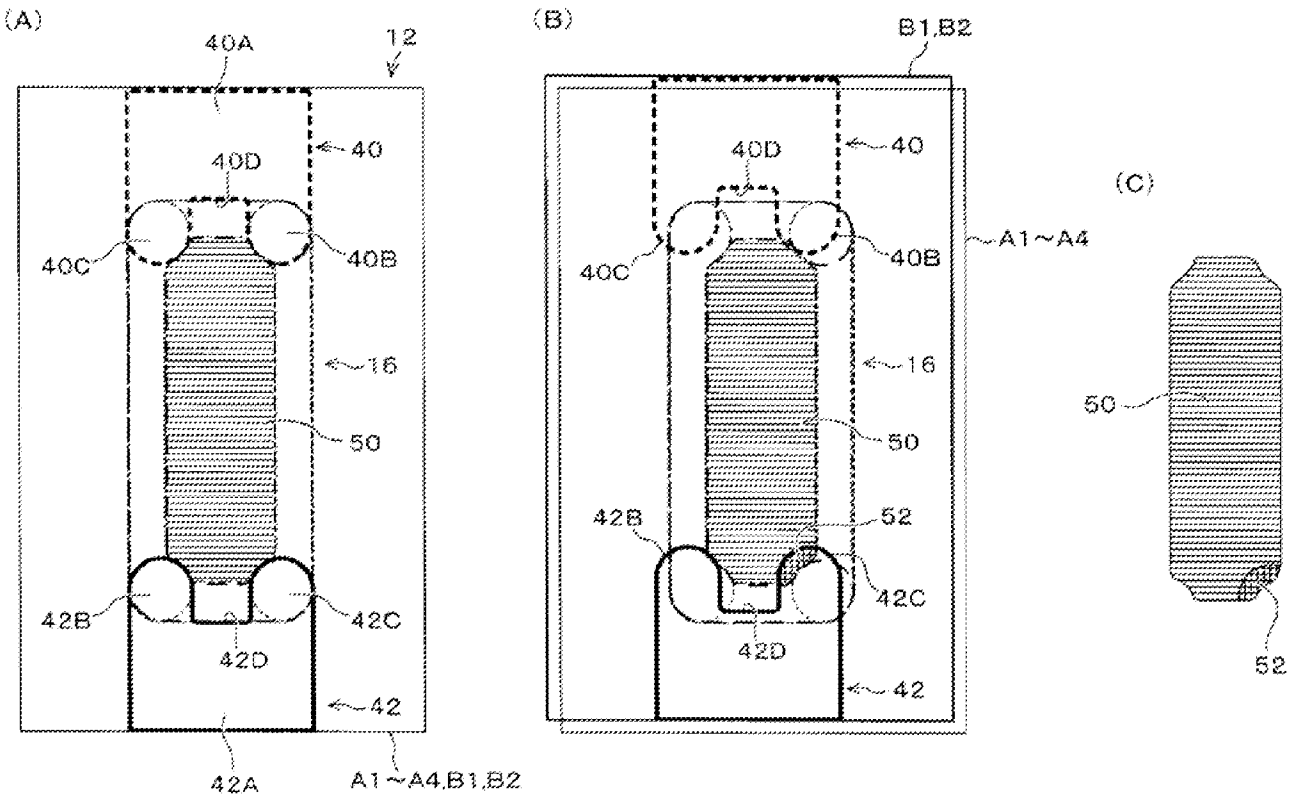
[FIG. 4] is a plan view showing how the core area of the multilayer chip inductor in Example 1 above changes, where (A) is a drawing showing a condition where displacement due to stacking does not occur, (B) is a drawing showing a condition where the circling patterns are displaced from the leader patterns, and (C) is a drawing showing the planar shape of the core part in (B) above.

First, Example 1 of the present invention is explained by referring to FIGS. 1 to 4. FIG. 1 is a drawing showing the multilayer chip inductor in this example, where (A) is a section view of the chip that has been cut in the lamination direction, while (B) is a section view of (A) above that has been cut along line #A-#A and is viewed in the direction of the arrow. FIG. 2 is an exploded perspective view showing the sheet lamination structure according to the manufacturing process of the multilayer chip inductor in this example, while FIG. 3 is a plan view showing the circling patterns and leader patterns of the multilayer chip inductor in this example. FIG. 4 is a plan view showing how the core area of the multilayer chip inductor in this example changes, where (A) is a drawing showing a condition where displacement due to stacking does not occur, (B) is a drawing showing a condition where the circling patterns are displaced from the leader patterns, and (C) is a drawing showing the planar shape of the core part in (B) above. It should be noted that, while magnetic sheets are used to form the multilayer chip inductor in this example, this is only one example and dielectric sheets can also be used.

As shown in FIGS. 1 and 2, a multilayer chip inductor 10 in this example comprises a magnetic body 14 of roughly rectangular solid shape being a laminate of multiple magnetic sheets, in which a spiral coil pattern 16 constituted by multiple circling patterns 30, 32, 34, 36 is buried. The circling patterns 30 through 36 each have roughly a C shape as shown in FIGS. 2 and 3, and by stacking these circling patterns 30 through 36 in a specified order and then conductively connecting them via a through-hole 22, the spiral coil pattern 16 circling in a rectangular shape along each side of the magnetic body 14 of roughly rectangular solid shape is obtained. External terminal electrodes 18, 20 formed on the end faces of a laminate chip 12 are connected to the coil pattern 16 via leader patterns 40, 42. These leader patterns 40, 42 are formed by conductors identical to the circling patterns 30 through 36.

In the illustrated example, the circling pattern 30 has connection land patterns 30A through 30D formed at its two ends and two corners. Similarly, the circling pattern 32 has connection land patterns 32A through 32D, the circling pattern 34 has connection land patterns 34A through 34D, and the circling pattern 36 has connection land patterns 36A through 36D. These circling patterns 30 through 36 are printed by conductor on magnetic green sheets (hereinafter referred to as "magnetic sheets") A1 through A4 using a circling screen on which multiple circling patterns are arranged.

On the other hand, the leader pattern 40 is such that, as shown in FIG. 3(E), a leader part 40A that reaches one short side of a magnetic sheet B1 and is formed at a position not overlapping with the circling parts of the spiral coil pattern 16, is continuously formed by the same conductor with two land patterns 40B, 40C corresponding to the land patterns 30A, 30B of the closest circling pattern 30 at the time of stacking It should be noted that a cutout 40D to remove the parts overlapping with the circling parts of the coil pattern 16 is formed between the land patterns 40B, 40C. Similarly, the other leader pattern 42 is such that, as shown in FIG. 3(F), a leader part 42A that reaches one short side of a magnetic sheet B2 and is formed at a position not overlapping with the circling parts of the spiral coil pattern 16, is continuously formed by the same conductor with two land patterns 42B, 42C corresponding to the land patterns 34A, 34B of the closest circling pattern 34 at the time of stacking A cutout 42D to remove the parts overlapping with the circling parts of the coil pattern 16 is formed between the land patterns 42B, 42C. As with the circling patterns 30 through 36, these leader patterns 40, 42 are printed by conductor on the magnetic sheets B1, B2 using a leader screen on which multiple leader patterns are arranged.

Next, an example of the manufacturing method in this example is explained. First, as shown in FIG. 2, a desired number of magnetic sheets D having no conductive pattern formed on them are stacked and the magnetic sheet B1 on which the leader pattern 40 has been formed is stacked on top. Then, a magnetic sheet A1 having a through-hole 22 formed at a position corresponding to one of the land patterns 40B, 40C of the leader pattern 40 and on which the circling pattern 30 is formed, is stacked. Thereafter, the magnetic sheet A1, magnetic sheet A2, magnetic sheet A3, magnetic sheet A4, magnetic sheet A1, . . . , are stacked in this order, with the ends of the respective circling patterns connected via the through-hole 22 to form a spiral coil pattern 16. Although the coil pattern 16 can have a desired number of windings, in the illustrated example the magnetic sheets are laminated so that the magnetic sheet A3 on which the circling pattern 34 is formed becomes the top layer, and the magnetic sheet B2 having a through-hole 22 at a position corresponding to one of the land patterns 34A, 34D and on which the leader pattern 42 is formed, is stacked on top. Stacked further on top are a desired number of other magnetic sheets D having no conductive pattern formed on them. The laminate thus obtained is sintered and the external terminal electrodes 18, 20 that connect to the exposed end faces of the leader patterns 40, 42 are formed on the end faces of the obtained laminate chip 12, to form the multilayer chip inductor 10.

Figure 9:
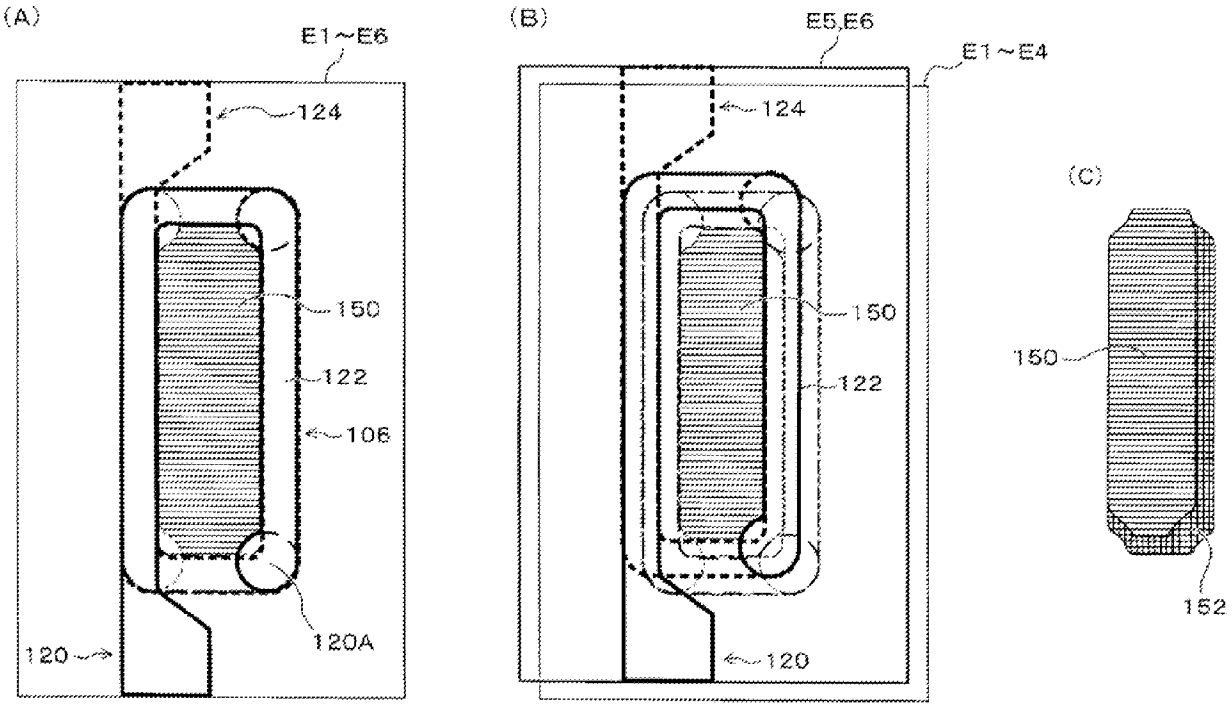
[FIG. 9] is a plan view showing how the core area of the multilayer chip inductor changes based on background art, where (A) is a drawing showing a condition where displacement due to stacking does not occur, (B) is a drawing showing a condition where the circling patterns are displaced from the leader patterns, and (C) is a drawing showing the planar shape of the core part in (B) above.

How the core area of the multilayer chip inductor 10 thus formed would change when the circling patterns 30 through 36 are displaced from the leader patterns 40, 42 is explained by referring to FIG. 4. When the condition where displacement due to stacking does not occur, as shown in FIG. 4(A), changes to a situation where the circling patterns 30 through 36 forming the spiral coil pattern 16 are displaced from the leader patterns 40, 42 stacked at the top and bottom thereof, as shown in FIG. 4(B), a cutoff area 52 of a core area 50 is only the portion that has been cut off by the displacement of the land pattern 42C of the leader pattern 42. In other words, in this example the cutoff area 52 resulting from displacement at the time of stacking can be substantially reduced as shown in FIG. 4(C), compared to when the aforementioned background art is used based on the same external dimensions (cutoff area 152 in FIG. 9(C)), which in turn makes it possible to maintain the inductance.

As explained above, Example 1 provides the following effects: (1) The magnetic sheets A1 through A4 on which the circling patterns 30 through 36 of roughly C shape are formed are stacked to form the spiral coil pattern 16, while at the same time the connection land patterns are provided at the corners and ends of the circling patterns 30 through 36. Then, the coil pattern 16 is connected to the external terminal electrodes 18, 20 using the leader patterns 40, 42 which each have the leader part formed at a position not overlapping with the circling parts of the coil pattern 16, two land patterns that continue to this leader part and are connected via the through-hole to the land patterns of the closest circling pattern, and a cutout formed between the two land patterns. Because of this, decrease in the core area 50 can be suppressed even when the circling patterns 30 through 36 are displaced from the leader patterns 40, 42 at the time of stacking, so that the inductance is maintained. (2) Because the leader patterns 40, 42 each have two land patterns 40B/40C, 42B/42C, respectively, and the land patterns are also provided at the corners of the circling patterns 30 through 36, it is not necessary to prepare different leader patterns according to the number of windings of the coil pattern 16 and therefore the number of windings can be changed with ease. This also has the effect of increasing the lamination accuracy.

Figure 5:
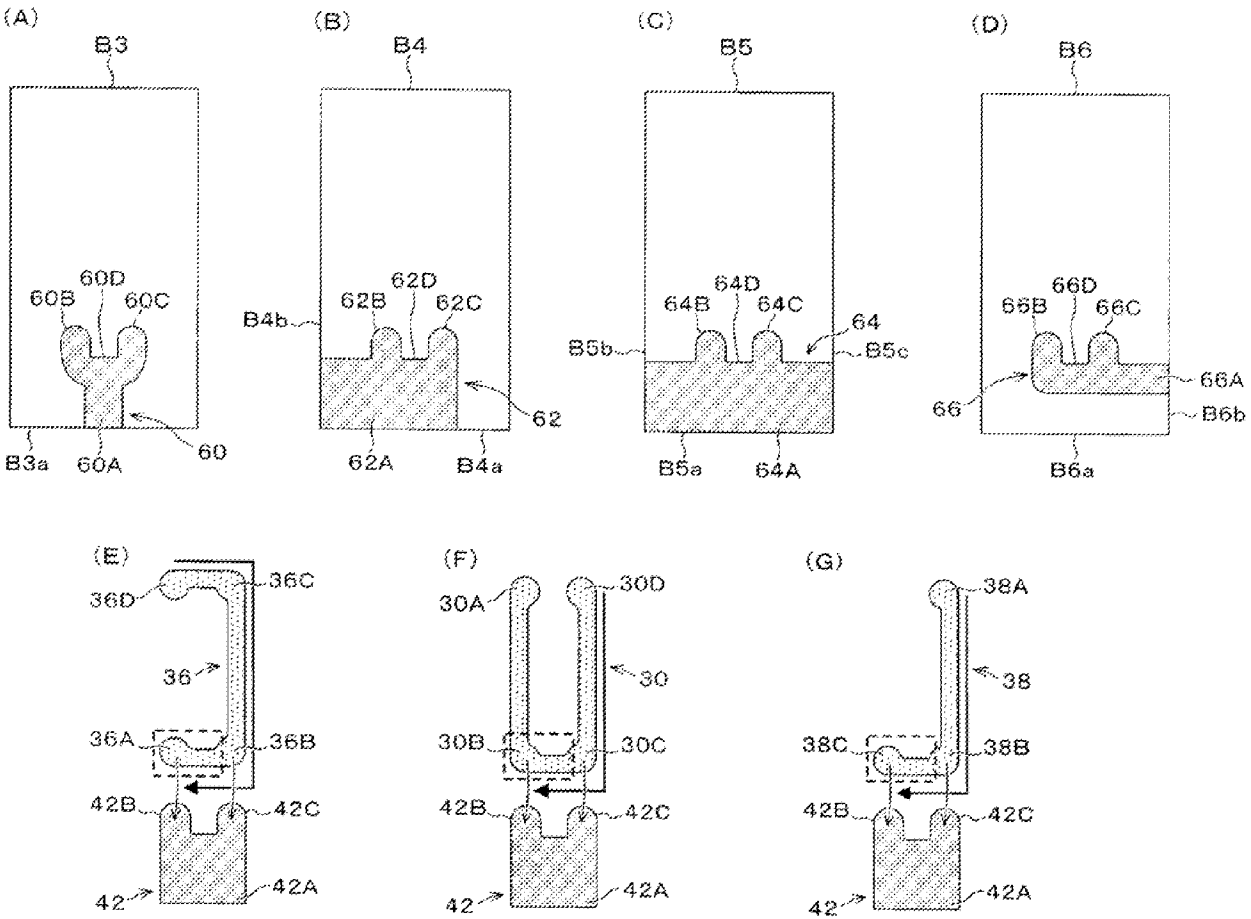
[FIG. 5] is a drawing showing another example of the present invention.
Figure 6:
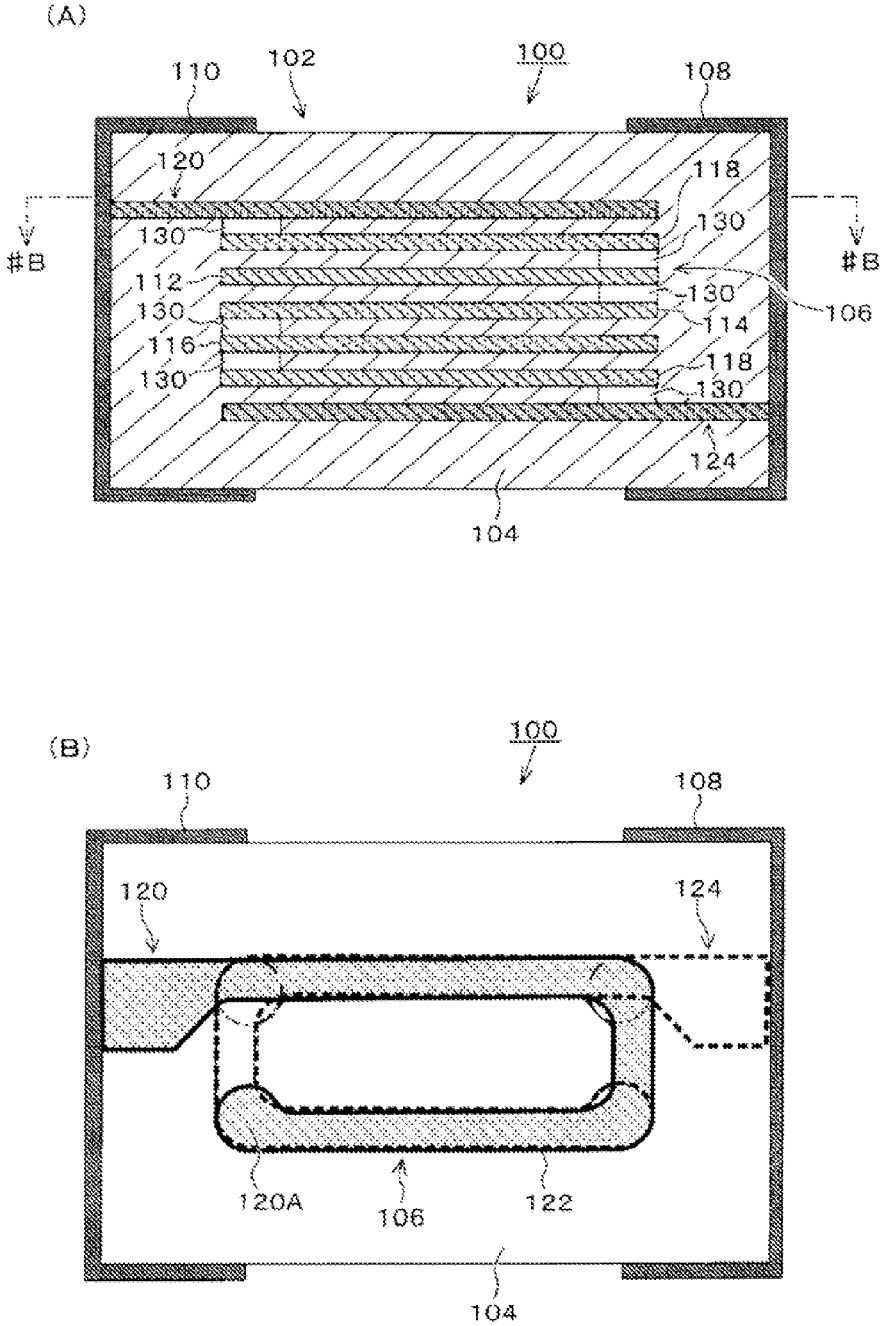
Fig. 6 Background Art
[FIG. 6] is a drawing showing a multilayer chip inductor based on background art, where (A) is a section view of the chip that has been cut in the lamination direction, while (B) is a section view of (A) above that has been cut along line #C-#C and is viewed in the direction of the arrow.
Figure 7:
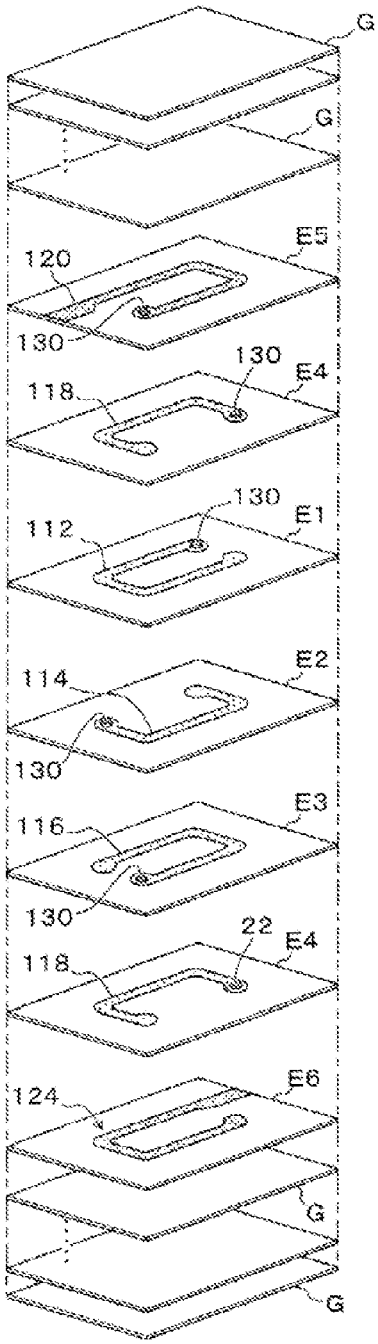
Fig. 7 Background Art
[FIG. 7] is an exploded perspective view showing the sheet lamination structure according to the manufacturing process of the multilayer chip inductor based on background art.
Figure 8:
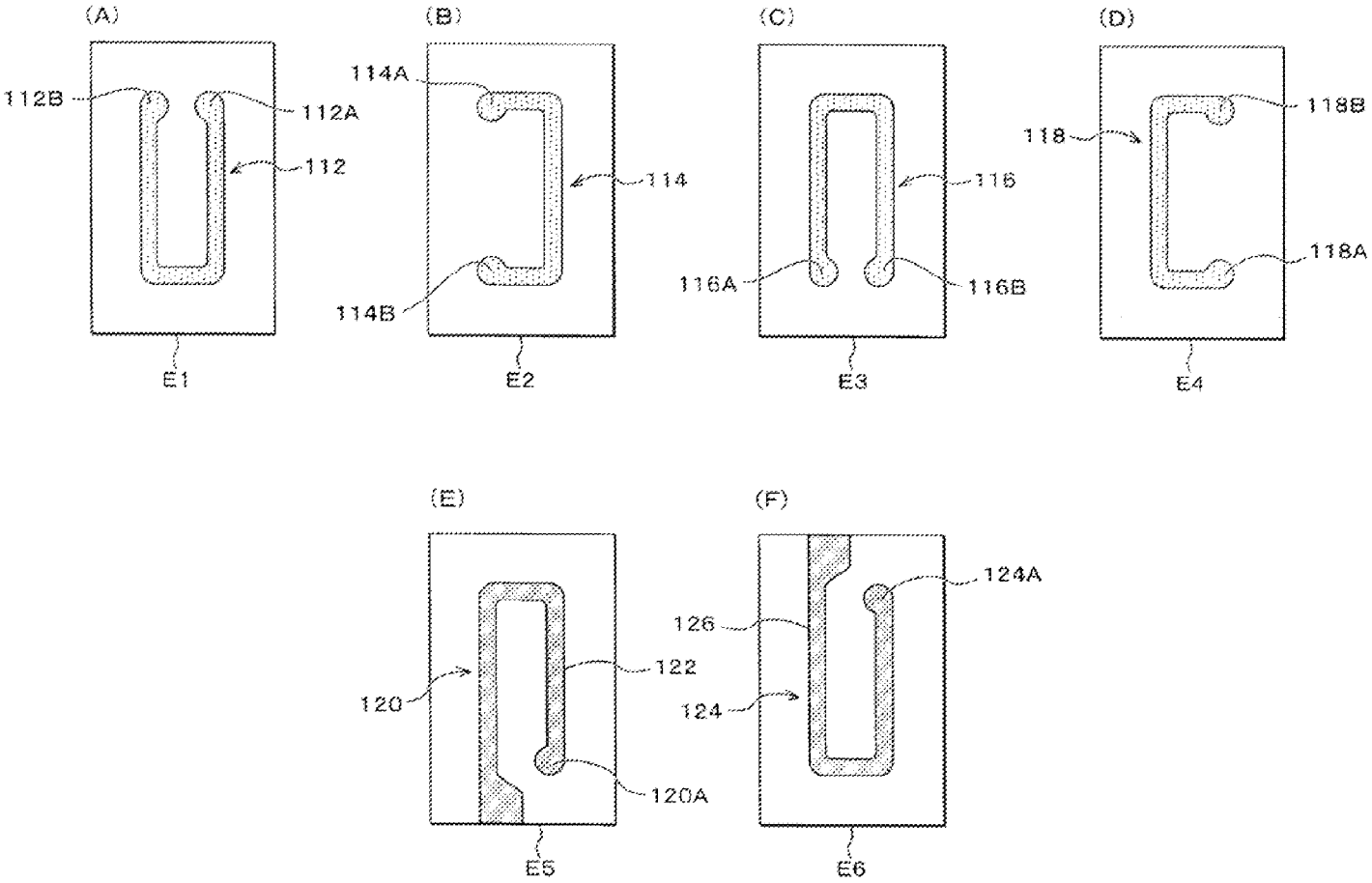
Fig. 8 Background Art
[FIG. 8] is a plan view showing the circling patterns and leader patterns of the multilayer chip inductor based on background art.

It should be noted that the present invention is not limited to the aforementioned example in any way and various changes may be added as long as they do not deviate from the key points of the present invention. For example, the present invention also includes the following: (1) The shapes of leader patterns 40, 42 shown in this example represent only one example and may be changed as deemed necessary. In the example shown in FIG. 5 (A), for example, a leader pattern 60 is formed on a magnetic sheet B3, where the width of a leader part 60A is smaller than the interval between the ends of land patterns 60B, 60C and a cutout 60D is provided between these land patterns 60B, 60C. Also in the example shown in FIG. 5(B), a leader pattern 62 is formed on a magnetic sheet B4, where this pattern has a leader part 62A reaching both one short side B4*a* and one long side B4*b* of the magnetic sheet B4, as well as two land patterns 62B, 62C and a cutout 62D. In the example shown in FIG. 5(C), a leader pattern 64 is formed on a magnetic sheet B5, where this pattern has a leader part 64A reaching three sides of the magnetic sheet B5 including one short side B5*a* and a pair of long sides B5*b*, B5*c*, as well as two land patterns 64B, 64C and a cutout 64D. Furthermore, in the example shown in FIG. 5(D), a leader pattern 66 is formed on a magnetic sheet B6, where this pattern has a leader part 66A reaching only one long side B6*b* of the magnetic sheet B6, as well as two land patterns 66B, 66C and a cutout 66D. Effects similar to those in Example 1 above can be achieved in any of these examples, but use of symmetrical leader patterns is recommended if improving the lamination accuracy is a consideration. Needless to say, FIGS. 5(A) through (D) above are also just examples and may be changed as deemed appropriate to achieve similar effects.

(2) While the leader patterns are connected to the land patterns on both ends of the circling patterns of roughly C shape in Example 1 above, this is also one example and may be changed as deemed necessary. As shown in FIG. 5(E), for example, compared to when the land pattern 36A at one end of the circling pattern 36 is connected to the land pattern 42B of the leader pattern 42, connecting the other land pattern 36B to the land pattern 42C of the leader pattern 42 causes the inductance to drop by the length of the pattern inside the dotted box shown in FIG. 5(E). In other words, fine-tuning of inductance by the amount in the dotted box is possible. As shown in FIG. 5(F), similarly in a case where the circling pattern 30 is connected to the leader pattern 42, compared to when the land pattern 38B is connected to the land pattern 42B, connecting the land pattern 30C to the land pattern 42C eliminates the need for the pattern inside the dotted box in the figure and thus reduces the inductance by the length of this pattern. In other words, fine-tuning of inductance by the amount in the dotted box is also possible here.

(3) While the circling patterns 30 through 36 have roughly a C shape in Example 1 above, they can be of any shape as long as a spiral coil pattern circling in a roughly rectangular shape can be formed. For example, the circling pattern 38 shown in FIG. 5 (G) has land patterns 38A, 38B, 38C at two ends and one corner of its roughly L shape. Here, too, compared to when the land pattern 38C is connected to the land pattern 42B, connecting the other land pattern 38B to the land pattern 42C eliminates the need for the pattern in the dotted box in the figure and reduces the inductance by the length of this pattern. In other words, fine-tuning of inductance by the amount in the dotted box is possible just like with the circling patterns of roughly C shape shown in FIGS. 5(E) and (F) above.

(4) The number of magnetic sheets laminated in the above example is only one example and may be increased or decreased as deemed necessary. Additionally, dielectric sheets can be used in place of magnetic sheets. (5) The shapes of cutouts 40D, 42D, 60D, 62D, 64D, 66D shown in the above example are also merely examples and any shape can be used as long as it does not cause the leader pattern to overlap with the circling parts of the coil pattern in areas other than the land patterns, or namely, as long as the shape does not cut off the core area.

INDUSTRIAL FIELD OF APPLICATION

According to the present invention, insulator layers on which a circling pattern is formed are stacked to form a spiral coil pattern, while at the same time connection parts are provided at the corners and ends of the circling patterns. Then, leader patterns are provided at the top and bottom of the coil pattern, where each leader pattern has a leader part formed at a position not overlapping with the circling parts of the coil pattern, as well as two connection parts that continue to the leader part and correspond to the connection parts of the circling pattern on the closest first insulator layer, together with a cutout formed between the two connection parts, and the leader patterns are connected to the external terminal electrodes. Because of this, decrease in core area can be suppressed even when the circling patterns are displaced from the leader patterns at the time of stacking, which makes the present invention applicable to multilayer chip inductors.

DESCRIPTION OF THE SYMBOLS

10: Multilayer chip inductor, 12: Laminate chip, 14: Magnetic body, 16: Coil pattern, 18, 20: External terminal electrode, 22: Through-hole, 30, 32, 34, 36, 38: Circling pattern, 30A through 30D, 32A through 32D, 34A through 34D, 36A through 36D, 38A through 38C: Land pattern, 40, 42: Leader pattern, 40A, 42A: Leader part, 40B, 40C, 42B, 42C: Land pattern, 40D, 42D: Cutout, 50: Core area, 52: Decreased area, 60 through 66: Leader pattern, 60A, 62A, 64A, 66A: Leader part, 60B, 60C, 62B, 62C, 64B, 64C, 66B, 66C: Land pattern, 60D, 62D, 64D, 66D: Cutout, 100: Multilayer chip inductor, 102: Laminate chip, 104: Magnetic body, 106: Coil pattern, 108, 110: External terminal electrode, 112, 114, 116, 118: Circling pattern, 112A, 112B, 114A, 114B, 116A, 116B, 118A, 118B, 120A, 124A: Land pattern, 120, 124: Leader pattern, 122, 126: Circling part, 130: Through-hole, 150: Core area, 152: Cutoff area, A1 through A4, B1 through B6, D, E1 through E6, G: Magnetic sheet, B3*a*, B4*a*, B5*a*, B6*a*: Short side, B4*b*, B5*b*, B5*c*, B6*b*: Long side

What is claimed is:

1. A multilayer chip inductor comprising:

a multilayer chip which comprises a laminate of roughly rectangular solid shape formed by stacking multiple insulator layers, in which a spiral coil pattern circling in a roughly rectangular shape along each side of the laminate is embedded; and external terminal electrodes provided on end faces of the multilayer chip, wherein the multiple insulator layers include:

multiple first insulator layers on each of which a partial circling pattern is formed, wherein the spiral coil pattern is formed by interconnecting via through-holes ends of the partial circling patterns on the multiple first insulator layers, and each of four corners of the roughly rectangular shape of the spiral coil pattern constituted by the partial circling patterns is aligned as viewed from above; and a pair of second insulator layers provided at a top and bottom of the laminate of the multiple first insulator layers and on each of which a leader pattern is formed, where each leader pattern has:

a leader part that is formed at a position not overlapping with the four corners of the spiral coil pattern as viewed from above and that is connected to the external terminal electrode, two connection parts that continue to the leader part and are aligned respectively with two of the four corners of the spiral coil pattern as viewed from above, and a cutout formed between the two connection parts by removing parts overlapping with the spiral coil pattern as viewed from above;

wherein the partial circling pattern on a closest first insulator layer and the leader pattern are connected via a through-hole at only one of the two connection parts of the leader pattern.

2. A multilayer chip inductor according to claim 1, wherein the leader patterns are each bilaterally symmetrical.

3. A method of manufacturing the multilayer chip inductor according to claim 1, comprising:

stacking, on one of the second insulator layers, the first insulator layer on which a through-hole is formed at a position corresponding to one of the two connection parts of the leader pattern on the one of the second insulator layers and which has the circling patterns;

stacking, on top thereof, the multiple first insulator layers in a specified order so as to form a spiral coil pattern;

further stacking, on top thereof, the other of the second insulator layers which has a through-hole at a position corresponding to one of closest two connection parts of the circling pattern on the first insulator layer at the top;

sintering the obtained laminate; and forming external terminal electrodes on end faces where the leader patterns are exposed.

4. A method of manufacturing the multilayer chip inductor according to claim 2, comprising:

stacking, on one of the second insulator layers, the first insulator layer on which a through-hole is formed at a position corresponding to one of the two connection parts of the leader pattern on the one of the second insulator layers and which has the circling patterns;

stacking, on top thereof, the multiple first insulator layers in a specified order so as to form a spiral coil pattern;

further stacking, on top thereof, the other of the second insulator layers which has a through-hole at a position corresponding to one of closest two connection parts of the circling pattern on the first insulator layer at the top;

sintering the obtained laminate; and forming external terminal electrodes on end faces where the leader patterns are exposed.

* * * * *